United States Patent [19]

Nakaoka et al.

[11] Patent Number: 4,715,905

[45] Date of Patent: Dec. 29, 1987

[54] METHOD OF PRODUCTING THIN SHEET OF HIGH SI-FE ALLOY

[75] Inventors: Kazuhide Nakaoka, Yokohama; Yoshikazu Takada, Kawasaki; Junichi Inagaki; Akira Hiura, both of Yokohama, all of Japan

[73] Assignee: Nippon Kokan Kabushiki Kaisha, Tokyo, Japan

[21] Appl. No.: 833,394

[22] PCT Filed: Sep. 26, 1985

[86] PCT No.: PCT/JP85/00534

§ 371 Date: Feb. 10, 1986

§ 102(e) Date: Feb. 10, 1986

[87] PCT Pub. No.: WO86/02102

PCT Pub. Date: Apr. 10, 1986

[30] Foreign Application Priority Data

Sep. 28, 1984 [JP] Japan ..... 59-201594

[51] Int. Cl.[4] ..... H01F 1/04

[52] U.S. Cl. ..... 148/111; 148/120; 148/2; 164/463; 164/476; 164/479; 164/480; 164/481

[58] Field of Search ..... 148/2, 111, 120; 164/463, 476, 479, 480, 481

[56] References Cited

U.S. PATENT DOCUMENTS

| | | | |
|---|---|---|---|
| 3,105,781 | 10/1963 | Walter | 148/111 |
| 3,162,554 | 12/1964 | Frischmann et al. | 148/111 |
| 3,413,165 | 11/1968 | Buchi et al. | 148/111 |
| 3,874,954 | 4/1975 | Wildschutz | 148/111 |

FOREIGN PATENT DOCUMENTS

| | | | |
|---|---|---|---|
| 55-41951 | 3/1980 | Japan . | |
| 56-13461 | 2/1981 | Japan | 148/120 |
| 57-94519 | 6/1982 | Japan | 164/479 |
| 58-113319 | 7/1983 | Japan . | |
| 59-16655 | 1/1984 | Japan | 164/463 |

*Primary Examiner*—John P. Sheehan

*Attorney, Agent, or Firm*—Moonray Kojima

[57] ABSTRACT

Fe alloy containing Si more than 4.0 wt % is produced by a thin plate casting process. The producing condition depends upon rapid solidification of Fe alloy from a molten condition at cooling rate of more than 1° C./sen to less than $10^{5}$° C./sec.

The obtained thin cast plates are subjected to a hot rolling of more than 30% at the temperature range of 600° to 800° C., and to the cold rolling to a determined thickness, followed pickling. By the above mentioned conditions, operations of the industrial scale may be practiced without cracks on the surface in the cold rolling excellent magnetic characteristics may be provided by passing the annealing after the cold rolling.

10 Claims, 5 Drawing Figures

METHOD OF PRODUCTING THIN SHEET OF HIGH SI-FE ALLOY

TECHNICAL FIELD OF THE INVENTION

This invention relates to a method of producing thin sheets of high Si-Fe alloy having excellent properties as soft magnetic materials.

BACKGROUND OF THE INVENTION

Since Si steel sheets are higher in magnetic permeability and electric resistance in comparison with electrical steel sheets containing no Si, and may be produced economically, those have been mass-produced as magnetic cores for electric power. It is known that Si steel sheet shows that the more is Si content, the better is the soft magnetic characteristic, and it shows a peak at 6.5% Si.

However, since, if Si content were more than 4.0%, an elongation would be rapidly lowered, ordinary cold rolling could not be carried out. Therefore, it has been industrially difficult to produce the thin sheets of high Si-Fe alloy containing Si more than 3%. With respect to such difficulties, it is reported that if hot rolling conditions are appropriately selected after hot forging, cold rolling would be possible to a certain extent (Ishizaka et al: Journal of Japan Institute of Metals Vol 30 (1966) No. 6).

This report teaches, melting the alloys containing 1 to 7% Si by high frequency induction furnace in the air so as to produce ingots of 50 mm square, hot forging the ingots until 15 mm thickness, machining these ingot test pieces on the surfaces until coming to 11 mm thickness, hot rolling them until 1 mm thickness at the temperatures of 1000°, 850° and 750° C. respectively; or hot rolling the samples until 5 mm thickness at 750° C., followed by hot-rolling until 1 mm thickness at 600° C., and hot rolling until 5 mm thickness 750° C., followed by hot rolling until 3 mm thickness at 600° C., hot rolling the samples until 1 mm thickness at 450° C.; and pickling and cold rolling them for observing appearance of crackings, in order to investigate influences of the hot rolling conditions to the cold workability. According to this report, at Si content of not more than about 4.7%, the cold rolling is possible, irrespectively of the hot rolling conditions, and at about 5% Si the cold rolling is also possible, irrespectively of the hot rolling conditions, if the edge of the hot rolled sheet is removed by machining. However in the steel sheet of more than about 6% Si, the cold rolling property thereafter depends upon the hot rolling temperatures, and especially the steel of around 6.5% Si may be cold rolled by performing the hot rolling at the temperatures of 600° to 750° C.

On the other hand, there is a rapid solidification process (cooling rate is ordinarily more than $10^{5°}$ C./sec) for making the thin sheets, other than the above mentioned rolling procedures (for example, Patent Specification Laid Open No. 16926/84).

Since the former of said procedures necessarily requires the hot forging before the rolling, the process cannot but be discontinuous due to presence of the hot forging, resulting in the complicated process and the high production cost. Further, if the cast ingot is subjected to the hot forging, cracks are generated, and therefore surface-machining prior to the hot rolling is necessary. In fact, the experiment in said report carried out the machining of about 27% (15 mm thickness to 11 mm) for the surface treatment. In addition, for rolling the steel at the temperatures of less than 750° C. where the cold rolling property was excellent, the steel could not be rolled directly at this temperature, and the rolling was involved with inconvenienses of undertaking a pre-rolling more than 750° C., followed by a subsequent rolling. As is seen, it is very difficult to practise the above mentioned processes in the industrial scale in view of the production cost and yield.

The latter of the rapid solidification process spouts the molten metal from the nozzle to the surface of a cooling roller and solidifies it, and is possible to produce thin plates continuously and at high yield. In this case, the maxiumum thickness is about 100μ, and the width is about 20 cm at the maximum. Therefore the usage is limited, and the production in the industrial scale has not yet been realized.

DISCLOSURE OF THE INVENTION

The point of the above mentioned conventional process (the former) is present in carrying out the rolling at the temperatures of 600° to 750° C. for improving the cold rolling property. But the rolling cannot be done instantly at such low temperatures, and it is indispensable as said above to perform the hot forging as the pre-treatment of the hot rolling. The forging is well known as the pre-treatment for processing and rolling material with less workability, but is inferior in the production and restrained with respect to shapes of products to be obtained. It is assumed that the reason exists in this point why the above process has not been yet practised.

The inventors made studies for improving the hot and cold workability of the high Si-Fe alloy, and confirmed that the hot rolling at the temperature between 600° C. and 750° C. was made possible by the hot forging because the structure was made fine, and found that a fine structure which was obtained by rapid solidification, might be substituted for said fine structure. Further, the inventors paid attention to a process of casting thin pieces as a method for realizing said rapid solidification. At present, the cast technical field has had interests in a thin plate casting process because processes may become simple, and many casting processes have been proposed. Thicknesses of the cast pieces thereby are about 30 to 0.5 mm, and the cooling rates are lower than the so-called rapid solidification process (cooling rate: more than $10^{5°}$ C./sec) but far higher than the ingot making process, and structures of produced steels are fine and uniform in grain, and further thicknesses are larger than the rapid solidification process, and since the thin plate casting process may continuously produce cast pieces having large width, it is characterized by using the conventional processes after the hot rolling.

The inventors made many investigations for employing said characteristics of the thin plate casting process, that is, direct production of high Si-Fe alloy plate of fine grains from the molten metal, and found that if the material produced by the thin plate casting process was hot rolled under determined conditions, it would be possible to produce high Si-Fe alloy excellent in the cold workability continuously and low production cost.

Thus, the invention comprises thin plate casting Fe alloy containing Si more than 4.0 wt% from the molten condition at the colling rate of more than 1° C./sec to less than $10^{5°}$ C./sec heating thin cast pieces at the temperature between 600° C. and 800° C., hot-rolling at reduction rate of more than 30% at said temperature range, and subjecting to pickling, cold-rolling and annealing.

The invention will be explained in detail.

The invention uses the high Si-Fe alloys containing Si more than 4.0 wt%, which will include such alloys of so-called sendust alloy and the like other than general high Si-Fe alloys. Ordinary high Si-Fe alloys contain around 4.0 to 7.0 wt% Si for providing magnetic characteristics. As mentioned above, magnetic permeability is increased by adding Si, and it becomes the maximum value when Si contact is about 6.5 wt%. Further, because an electric resistance is increased by Si addition, iron loss is lowered. In the materials of less than 4.0% Si, the hot rolling and the cold rolling are easily possible in the conventional processes.

The invention also includes so-called sendust alloy and high magnetic permeable alloy called as super sendust alloy. These alloys are composed of, (a) Si: 8.0 to 10.0 wt%, Al: 4.0 to 7.0 wt%, the rest being substantially Fe and inavoidable impurities (b) Si: 4.0 to 8.0 wt%, Al: 2.0 to 6.0 wt%, Ni: 1.0 to 5.0 wt%, the rest being substantially Fe and inavoidable impurities.

They are brittle and the conventional art has not produced thin sheets via the rolling procedures. According to the invention, it is possible to produce thin sheets in the industrial scale with respect to the high magnetic permeable alloys which are difficult to be processed and further other materials with less formability.

The present invention solidifies Fe-alloy of the above said chemical composition from the melts at the cooling rate of more than 1° C./sec to less than $10^{5}$° C./sec in the thin plate casting process. FIG. 1 shows relationship between the cooling rate and the crystal grain size of rapidly solidified 6.5 wt% Si steel. As is seen from this diagram, since the crystal grain size of the cast plate becomes larger as the cooling rate becomes slower, the hot workability is deteriorated at a subsequent hot rolling. Therefore, the invention determines the lower limit of the cooling rate at 1° C./sec for providing the fine and uniform grain structure. In order to increase the cooling rate more than $10^{5}$° C./sec in the thin plate casting process, the thickness of the cast piece should be not more than 0.1 mm, and it will be difficult thereby to obtain practicable materials having large width. Therefore, the invention determines the upper limit of the cooling rate at less than $10^{5}$° C./sec. The casting of thin plates may depend upon any process which can realize the above mentioned cooling rates, and any include twin roller process, melt spinning process, spray casting process, or hazellette process.

The thus produced thin cast plate is undertaken with the hot rolling at the temperatures of 600° to 800° C. and the reduction of more than 30%. This hot rolling may be performed after the thin cast plate is heated at the temperatures of 600° to 800° C., or until the temperature of the produced thin cast plate does not become less than 600° C.

FIG. 2 shows the relationship between the hot rolling temperatures and the possible hot-rolling reduction, and FIG. 3 shows the relationship between the hot rolling temperatures and the cold rolling reduction after the hot rolling at the reduction of 80% at said hot rolling temperatures. The 6.5 wt% Si steels were used in the experiments, which were cast into thin plate (thickness: 5 mm) and then, hot rolled at the reduction rate of 80%. The hot and cold workability were evaluated by the cold rolling reduction where fine cracks would be visually observed. It is seen from FIG. 2 that the hot rolling of the reduction being 80% is possible at the temperatures of more than 600° C. However, if the hot rolled steel was subjected to the cold rolling, the cold rolling of the reduction rate of more than 60% was possible with only the samples hot rolled at the temperature range between about 600° C. and 800° C., as shown in FIG. 3. FIG. 4 shows the relationship between the cold rolling reduction after the hot rolling was performed at the temperature of 730° C. until the determined reduction, and the hot rolling reduction rate. As is seen from FIG. 4, the cold rolling is impossible if the hot rolling reduction is less than 30%. Further, FIG. 5 shows influences of the hot rolling condition (the hot rolling reduction and the hot rolling temperatures) to the cold rolling reduction. Thus, in the invention it is necessary to perform the hot rolling of the more than 30% reduction in the temperature range of 600° to 800° C.

The steel sheet is carried out, after the hot rolling, with the pickling, cold rolling and annealing. The annealing after the cold rolling is important for providing the objective magnetic characteristics. Especially, the steel of 6.5 wt% Si may be imparted with anisotropy by appropriate combination of the cold rolling and the annealing, and it is possible therewith to produce grain-oriented high Si-Fe alloy. At the final annealing, it is possible to form an insulation-coating, and perform a heat treatment in the magnetic field.

According to the invention, the under mentioned effects may be obtained when producing thin sheets of high Si-Fe alloy excellent in magnetic characteristisc, (1) Complicated processes such as ingot-making, reheating and hot forging are not required, and the energy may be saved as much;

(2) Since the material is not processed before the hot rolling, cracks do not appear on the surface, and only pickling after the hot rolling is enough for carrying the cold rollings;

(3) The products may be coiled;

(4) Since the structure of the cast piece by the thin plate casting process is composed of columnar grains oriented in the thickness, the anisotrophy may be easily controlled by the heating treatment after the hot rolling;

(5) High Si-Fe alloy or other materials with less workability may be produced in the industrial scale, which have been conventionally impossible to be produced in the industrial scale.

THE MOST PREFERRED EMBODIMENT FOR PRACTISING THE INVENTION

EXAMPLE 1

Figure 1:
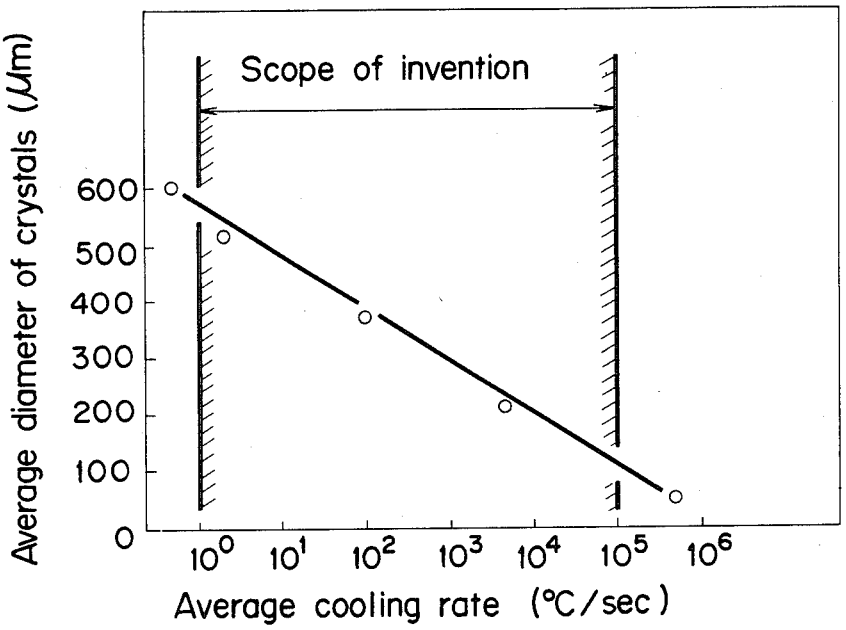
FIG. 1 shows the relationship between the average cooling rate of the solidification and the average crystal grains.
Figure 2:
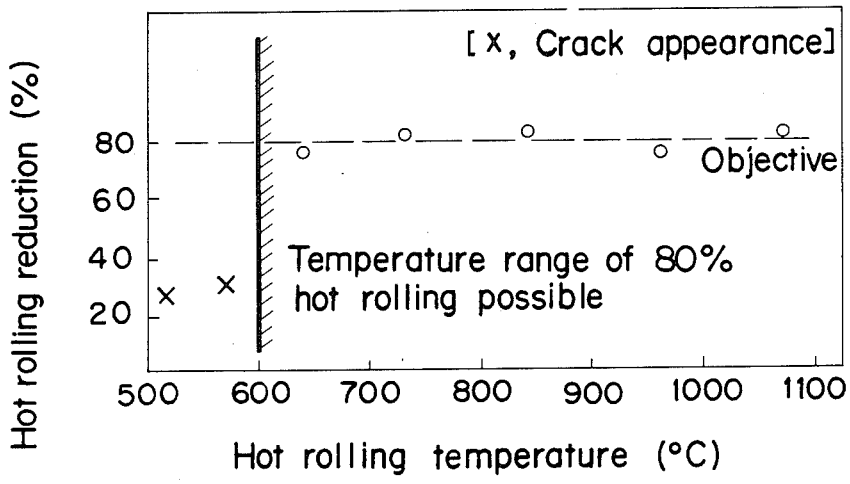
FIG. 2 shows the relationship between the hot rolling temperatures and the possible hot rolling reduction.
Figure 3:
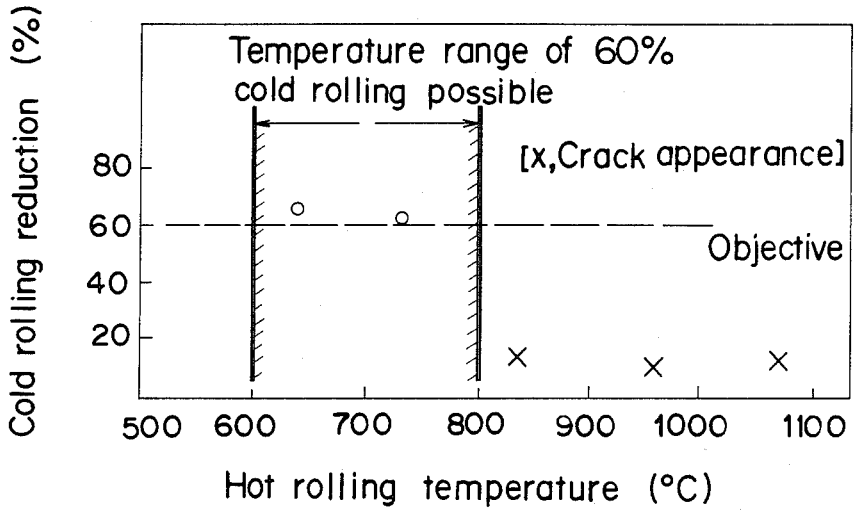
FIG. 3 shows the relationship between the hot rolling temperatures and the cold rolling reduction after the hot rolling of the reduction rate being 80%.
Figure 4:
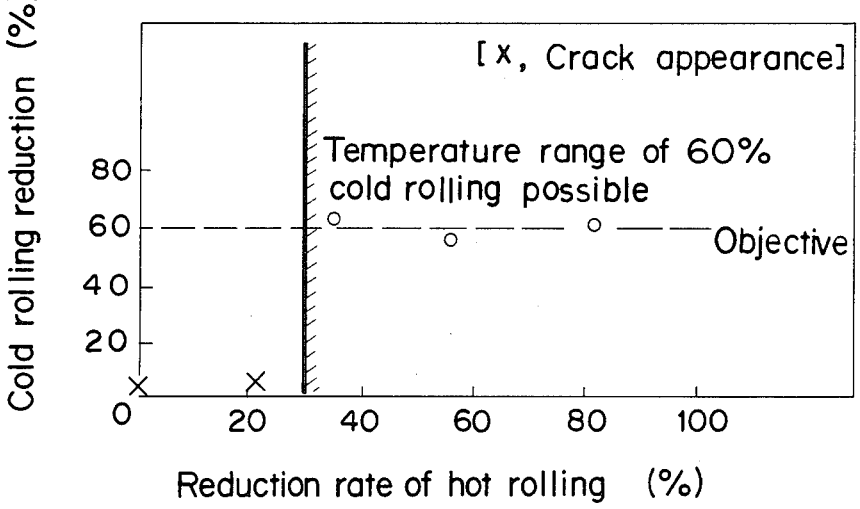
FIG. 4 shows the relationship between the hot rolling reduction rate at the temperature of 730° C. and the possible cold rolling rate.
Figure 5:
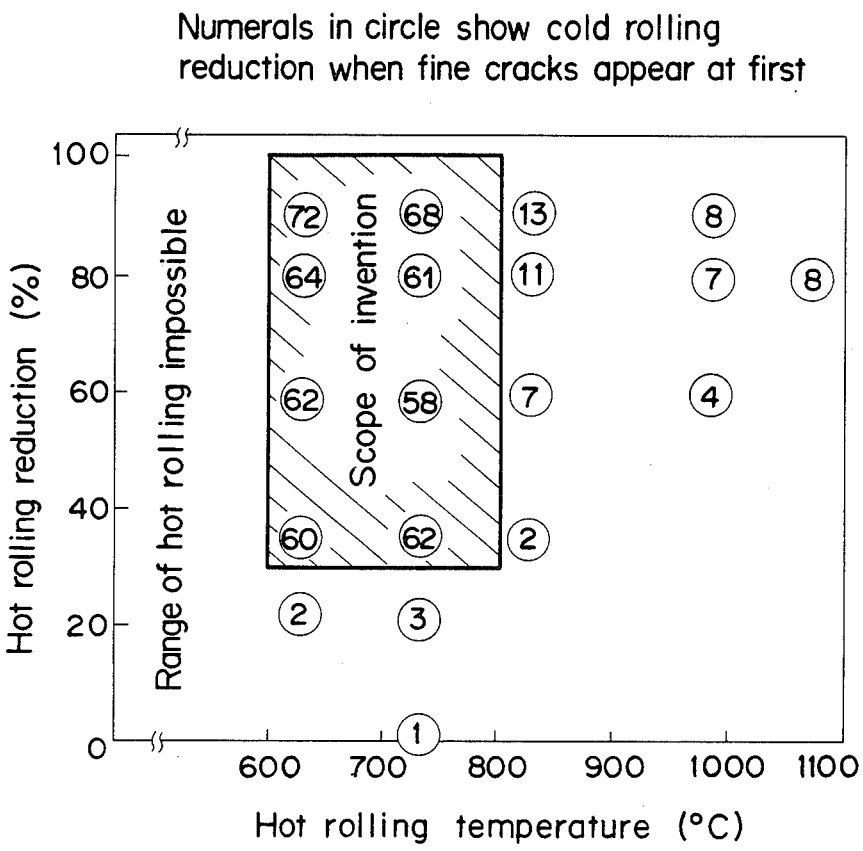
FIG. 5 shows influences of the hot rolling conditions (hot rolling rate and the hot rolling temperatures) to the cold workability.

The steel of Table 1 was molten, refined, and cast in the thin plate casting machine of the twin roller type, and formed in 500 mm width and 5 mm thickness. The pieces were hot rolled, aiming at the reduction of 80% as changing the rolling temperatures, and the pieces rolled at the aimed reduction rate were cold rolled, after pickling, aiming at the reduction of 60%. Table 2 shows the rolling conditions thereof. As is seen from this Table, according to the invention, the hot rolling was possible without forging prior to the hot rolling, besides without pre-rolling, and those hot rolled at the temperature range between 600° C. and 800° C. could be subjected to the cold rolling for producing thin sheets of 500 mm width and 0.4 mm width.

TABLE 1

| | | | (wt %) | | | |
|---|---|---|---|---|---|---|
| C | Si | Mn | P | S | Al | N |
| 0.011 | 6.27 | 0.003 | tr. | 0.0011 | tr. | 0.0026 |

[Chemical composition of test piece]

TABLE 2

| Method of casting | Pretreatment of rolling | Hot-rolling temperature | Hot-rolling conditions | Cold-rolling conditions | Remarks |
|---|---|---|---|---|---|
| Tin plate casting | No | 550° C. | Breakage | — | — |
| Tin plate casting | " | 625° C. | Rolling possible | Rolling possible | Inv. |
| Tin plate casting | " | 731° C. | Rolling possible | Rolling possible | " |
| Tin plate casting | " | 790° C. | Rolling possible | Rolling possible | " |
| Tin plate casting | " | 865° C. | Rolling possible | Breakage at rolling | — |
| Ingot | " | 750° C. | Breakage at rolling | — | Com. |
| " | Press forging | 700° C. | Breakage at rolling | — | " |

Note:
Inv.: Materials of the invention
Com.: Materials of the comparative example

EXAMPLE 2

The thin plates (thickness: 5 mm) of Table 2 were hot rolled at the reduction of 80% at the temperature of 700° C., followed by pickling, subsequently cold rolled at the reduction of 70%, and annealed in the dry $H_2$ gas atmosphere of 1200° C. for 30 min, followed by measuring the magnetic characteristics. Table 3 shows the measuring results.

As recognized from Table 3, in the products by the thin plate casting process, the improvement of the processing property and the uniformalization by the fine structure were provided and the improvement of the magnetic characteristics was provided.

TABLE 3

| Test processes | Direct current magnetic characteristics | | | |
|---|---|---|---|---|
| | $B_8$ (KB) | Hc (Oe) | μm | Δμm (%)*1 |
| Invention process | 15 | 0.2 | 34000 | 5 |
| Conventional process*2 | 13 | 0.2 | 23000 | 30 |
| Ingot*3 | 11 | 0.8 | 10000 | 43 |

*1Dispersions of 10 points in the samples of 1 m
*2Ishizuka et al: Journal of Japan Institute of Metals vol. 30 (1966) No. 6
*3Test plates were cut from the ingot

What is claimed is:

1. A method of producing thin sheets of Si-Fe alloy, comprising the steps of preparing molten Si-Fe alloy composition containing more than 4.0 weight percent Silicon;

casting the molten Si-Fe alloy to form plates of thickness ranging from 0.1 mm to 30 mm and cooling at a cooling rate of 1° C./sec to less than $10^5$° C./sec, said casting being by thin plate casting;

subsequently hot rolling the cast plates at a reduction rate of more than 30 percent and at a temperature of between 600° C. and 800° C.; and subsequently pickling, cold rolling and annealing.

2. A method as claimed in claim 1, wherein Fe alloy contains Si 4.0 to 7.0 wt%.

3. A method as claimed in claim 1, wherein Fe alloy contains Si 8.0 to 10.0 wt% and Al 4.0 to 7.0 wt%.

4. A method as claimed in claim 1, wherein Fe alloy contains Si 4.0 to 8.0 wt%, Al 2.0 to 6.0 wt% and Ni 1.0 to 5.0 wt%.

5. The method of claim 1, wherein the plates are first cast and cooled, then the temperature is made to be between 600° C. and 800° C., and then the plates are subjected to hot rolling at a reduction rate of more than 30 percent.

6. The method of claim 1, wherein the plates are first cast and subjected to cooling, and the hot rolling is undertaken during the time the temperature is between 600° C. and 800° C. during the cooling to 600° C., and with a reduction rate of more than 30 percent.

7. The method of claim 1 wherein said casting is by a thin plate casting process utilizing twin roller process.

8. The method of claim 1, wherein said casting is by a thin plate casting process utilizing a melt spinning process.

9. The method of claim 1, wherein said casting is by a thin plate casting process utilizing a spray casting process.

10. The method of claim 1, wherein said casting is by a thin plate casting process utilizing a hazellette process.

* * * * *